United States Patent [19]

Prickett et al.

[11] Patent Number: 5,049,709

[45] Date of Patent: Sep. 17, 1991

[54] INDEX ROTARY SWITCH WITH ROTOR CONTACT MEMBER HAVING L-SHAPED ARMS

[75] Inventors: Tomm Prickett, Roscoe; Melvin S. Nation, Elmhurst, both of Ill.

[73] Assignee: Illinois Tool Works, Inc., Glenview, Ill.

[21] Appl. No.: 472,655

[22] Filed: Jan. 30, 1990

[51] Int. Cl.[5] ..... H01H 19/62

[52] U.S. Cl. ..... 200/527; 200/257; 200/273; 200/275

[58] Field of Search ..... 200/526, 527, 528, 568, 200/570, 571, 253, 257, 260, 273, 275, 284, 11 R, 11 A, 116, 11 TW, 11 TL, 11 H

[56] References Cited

U.S. PATENT DOCUMENTS

| | | | |
|---|---|---|---|
| 3,041,429 | 6/1962 | Elliott | 200/527 |
| 3,204,067 | 8/1965 | Brown | 200/527 |
| 3,676,617 | 7/1972 | Miller | 200/275 |
| 3,748,419 | 7/1973 | Torrey et al. | 200/570 |
| 3,983,354 | 9/1976 | Gammie et al. | 200/571 |
| 4,016,387 | 4/1977 | Aberer | 200/11 R |
| 4,293,751 | 10/1981 | Van Benthuysen et al. | 200/527 |
| 4,424,424 | 1/1984 | Hollenbeck, Jr. | 200/571 |
| 4,891,476 | 1/1990 | Nation et al. | 200/527 |

*Primary Examiner*—Henry J. Recla
*Assistant Examiner*—Glenn T. Barrett
*Attorney, Agent, or Firm*—Schwartz & Weinrieb

[57] ABSTRACT

An index rotary switch includes a housing, stationary contact members, a rotor contact member, and a push-button-operated actuator device. The stationary contact members are disposed within the housing for defining an infinite number of alternately achieved on-and-off positions. The rotor contact member is disposed for rotation within the housing for wipingly engaging the stationary contact members. The rotor contact member is formed with a rectangularly-shaped flat portion and a plurality of resilient L-shaped arms extending downwardly from respective edges thereof. The L-shaped arms have arcuate-shaped contacts formed upon their free ends so as to wipingly engage the stationary contacts. The actuator device is disposed within the housing and is operatively connected to the rotor contact member for sequentially rotating the rotor contact member so that the arcuate-shaped contacts alternately index with respect to the on-and-off positions upon successive actuations of the actuator device.

22 Claims, 2 Drawing Sheets

INDEX ROTARY SWITCH WITH ROTOR CONTACT MEMBER HAVING L-SHAPED ARMS

FIELD OF THE INVENTION

This invention relates generally to rotary switch devices and more particularly, it relates to an improved index rotary switch of the push-push type which is used to successively make and break electrical contacts through successive actuation of a pushbutton. For example, the present invention has particular useful applications in maplight switches, on/off radio switches, instrument panel switch arrays and other accessory functions associated generally with an automotive vehicle.

BACKGROUND OF THE INVENTION

As is generally known, there are prior art index rotary switches which utilize a point-to-point type of contact design for successively producing on-off switching operations. Such types of switches suffer from a disadvantage when subjected to vibrations or movements which are typically encountered in automotive vehicles since there is a momentary making and breaking of contacts. When these switches are used to control a light, there would consequently be caused a flickering of the same. Furthermore, these switches have a relatively small contact area which limits their current carrying capability.

In an attempt to overcome the disadvantages of the prior art index rotary switches, there is shown and described in application Ser. No. 191,359 filed May 5, 1988, and now U.S. Pat. No. 4,891,476, and entitled "Index Rotary Switch" a rotary switch of the push-push type which has improved operational characteristics and an increased useful life. This application Ser. No. 191,359 was filed in the names of the inventors Melvin S. Nation and Robert W. Krawczyk and is assigned to the same assignee as the present invention, which is hereby incorporated by reference.

The present invention represents an index rotary switch having an alternate construction with respect to that of the embodiment shown in the foregoing application Ser. No. 191,359. The instant invention includes a rotor contact member which is formed of a rectangularly-shaped flat portion and a plurality of resilient L-shaped arms extending downwardly from respective edges thereof. Each of the L-shaped arms has an arcuate-shaped contact formed upon its free end so as to wipingly engage stationary contact members.

OBJECTS OF THE INVENTION

Accordingly it is a general object of the present invention to provide an improved index rotary switch which is relatively simple and economical to manufacture and assemble, but yet overcomes the disadvantages of the prior art switches.

It is an object of the present invention to provide an improved index rotary switch which includes a rotor contact member which is formed of a rectangularly-shaped flat portion and a plurality of resilient L-shaped arms extending downwardly from respective edges thereof.

It is still another object of the present invention to provide an improved index rotary switch which includes three stationary contact members of a unique construction so as to define an infinite number of alternating on-and-off positions when successively engaged by means of the rotor contacts.

SUMMARY OF THE INVENTION

In accordance with these aims and objectives, the present invention is concerned with the provision of an improved index rotary switch which includes a housing, stationary contact members, a rotor contact member, and a pushbutton-operated actuator device. The stationary contact members are disposed within the housing for defining an infinite number of alternately on-and-off positions. The rotor contact member is disposed for rotational movement within the housing for wipingly engaging the stationary contact members. The rotor contact member is formed of a rectangularly-shaped flat portion and a plurality of resilient L-shaped arms extending downwardly from respective edges thereof. The L-shaped members have arcuate-shaped contacts formed upon their free ends so as to wipingly engage the stationary contact members. The pushbutton-operated actuator device is disposed within the housing and is operatively connected to the rotor contact member for sequentially rotating the rotor contact member so that the arcuate-shaped contacts alternately index to the on-and-off positions upon successive actuations of the actuator device.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout the several views, and wherein.

DESCRIPTION OF THE PREFERRED EMBODIMENTS

Figure 1:
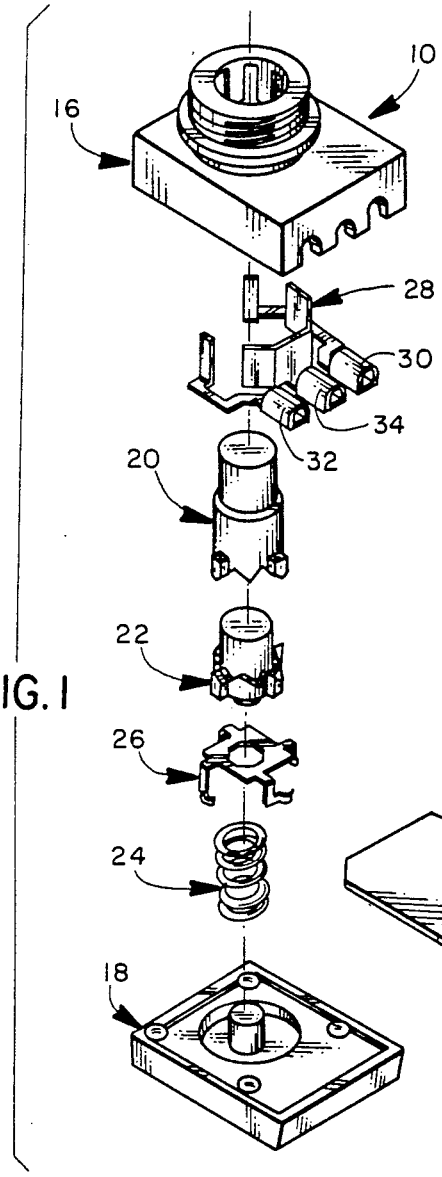
FIG. 1 is an exploded view of an index rotary switch, constructed in accordance with the principles of the present invention.
Figure 2:
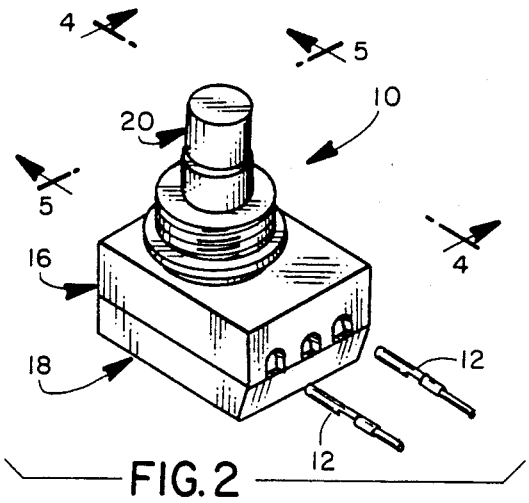
FIG. 2 is a perspective view of the index rotary switch of FIG. 1, illustrating its use in connection with a male plug type connector.
Figure 3:
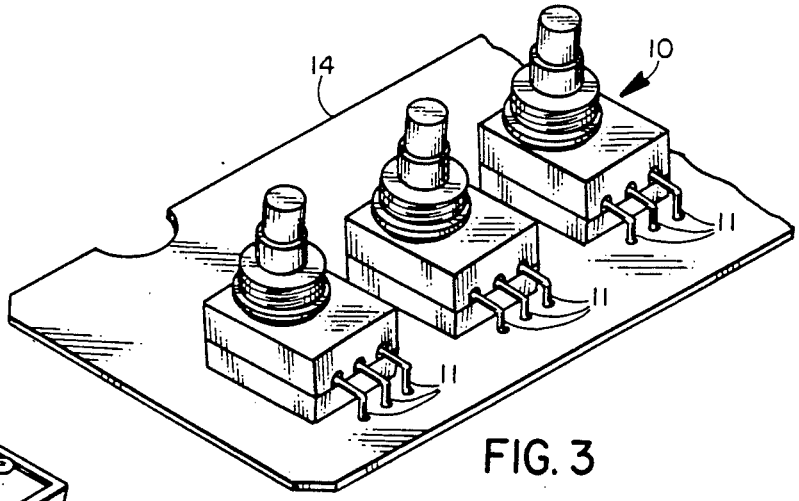
FIG. 3 is a perspective view of the index rotary switch of FIG. 1, having an alternate terminal contact set with spades suitable for mounting upon a printed circuit board.

Referring now in detail to the various views of the drawings, there is illustrated in FIGS. 1 through 3 an improved index rotary switch of the push-push type which is constructed in accordance with the principles of the present invention and which is designated generally by means of reference numeral 10. The rotary switch 10 is shown in its fully assembled condition in FIG. 2 and is further depicted to accept a male plug type connector 12. The rotary switch 10 of the present invention may also be provided with an alternate terminal contact set having spades 11 suitable for mounting directly upon a printed circuit board 14, as is illustrated in FIG. 3.

The rotary switch 10 includes an electorally insulative housing formed of an upper or top portion 16 and a lower or bottom cover portion 18 which mates with the top portion 16. The switch further consists of a pushbutton actuated index rotary actuator mechanism which is formed of a pushbutton or plunger 20, an actuator cam follower 22, and an actuator return coil spring 24. The switch also includes an electrical rotor contact member 26 and a terminal contact set 28 formed of three electrically isolated stationary electrical contact members 30, 32 and 34.

The rotary actuator mechanism is conventional and is of the type used in an electrical switch for sequentially rotating a rotary electrical contact so as to index with stationary electrical contacts. Such a rotary actuator mechanism of the prior art electrical switch is illustrated and described in U.S. Pat. No. 4,293,751 issued on Oct. 6, 1981, to Van Benthuysen et al. Therefore, the detailed construction of the plunger 20, cam follower 22, and return coil spring 24 will not be described. The coaxial movement of the plunger 20 and the cam follower 22 and the subsequent angular movement of the cam follower 22 due to the biasing force of the return coil spring 24 should be quite apparent to those skilled in the art in light of the description of operation of the corresponding plunger 46, rotor 64 and spring 80 in the '751 patent, which is hereby incorporated by reference.

Figure 4:
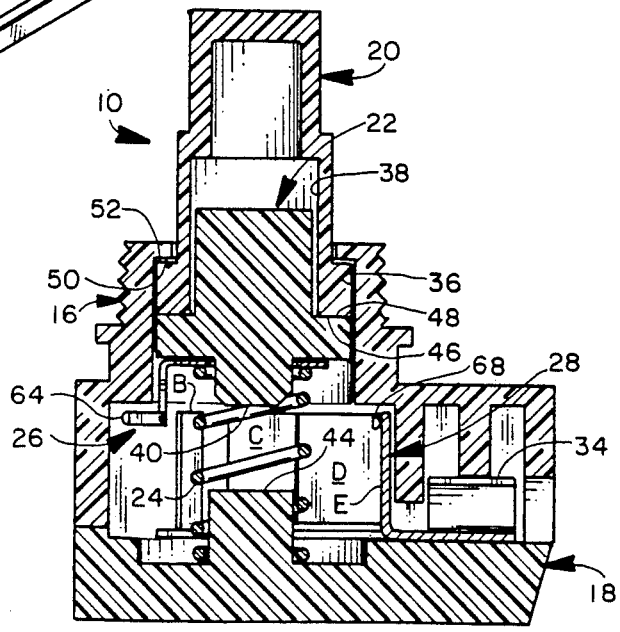
FIG. 4 is a vertical, cross-sectional view, taken along the lines 4—4, of the switch of FIG. 2 in its fully assembled condition, illustrating the details of construction.
Figure 5:
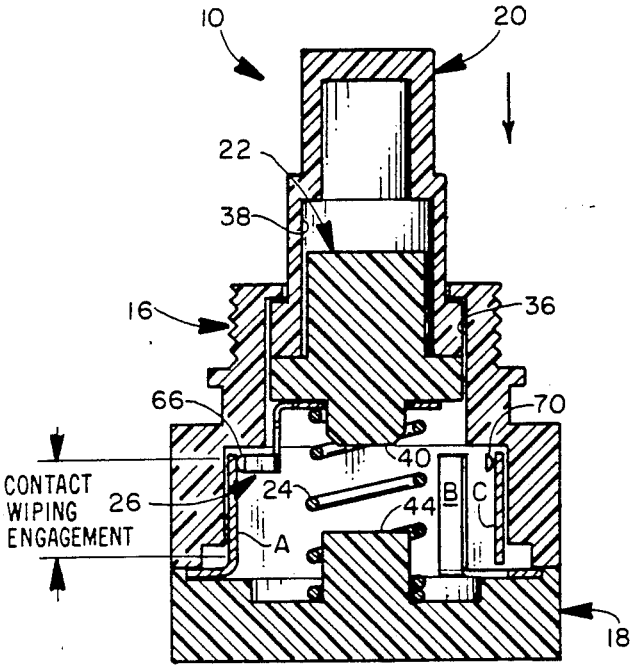
FIG. 5 is a cross-sectional view, taken along the lines 5—5 of FIG. 2.

In FIGS. 4 and 5, there are shown the pushbutton or plunger 20 received within a cylindrical pushbutton passage 36 formed within the top housing portion 16. The plunger is provided with an internal cylindrical cavity 38 within which the actuator cam follower 22 is slidably received. The cam follower 22 is also free for rotational movement within the cavity 38. The cam follower 22 is further provided with a downwardly extending projection or post 40 that operatively engages the rotor contact member 26 so as to cause the rotor contact member 26 to index with respect to the stationary contact members of the terminal contact set 28 in an on-and-off timing relationship upon successive actuations of the plunger 20.

The post 40 has an octagonally-shaped configuration which is slidably received within the octagonally-shaped aperture 42 formed within the center area of the rotor contact member 26. As will be noted, the interengagement of cam follower 22 and the top surface of the rotor contact member 26 allows for rotation of the contact member 26 when the cam follower 22 is rotated. One end of the return coil spring 24 is held against the underneath surface of the rotor contact member 26. The opposite end of the return spring 24 receives a circular support post 44 formed upon the central portion of the interior bottom surface of the lower housing portion 18. As a result, the rotor contact member is axially supported between the lower surface of the cam follower 22 and the upper end of the return spring 24 against axial movement and is capable of only rotational movement.

With the plunger 20 in the undepressed condition as shown, the return spring serves to bias the cam follower shoulder 46 against the lower plunger shoulder 48. As a consequence, the upper plunger shoulder 50 is biased against a stop shoulder 52 formed within the upper housing portion 16.

Figure 6A:
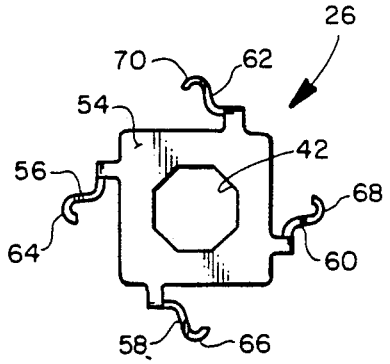
FIGS. 6(*a*)–6(*c*) are various views of the rotor contact member, illustrating the details of construction.
Figure 6B:
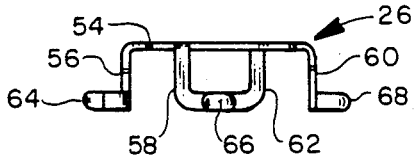

Referring now to FIGS. 6(*a*)–6(*b*), the rotor contact member 26 includes a generally square-shaped flat portion 54 and has the octagonally-shaped aperture 42 defined within its central area. The flat portion 54 has four electrically connected, resilient L-shaped arms 56, 58. 60 and 62 extending downwardly from the respective edges thereof. The free ends of the L-shaped arms 56–62 are provided with corresponding arcuate-shaped contacts 64, 66, 68 and 70 for wipingly engaging the stationary contact members of the terminal contact set, as will be explained hereinafter.

Figure 7A:
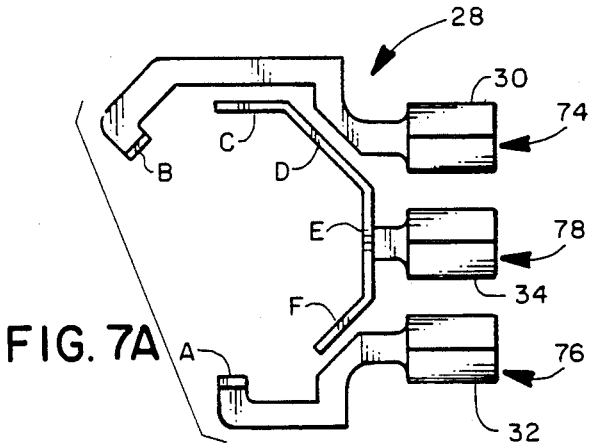
FIGS. 7(*a*)–7(*c*) are various views of the terminal contact set, illustrating the details of construction.
Figure 7B:
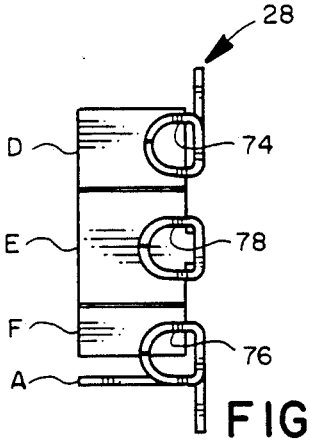
Figure 7C:
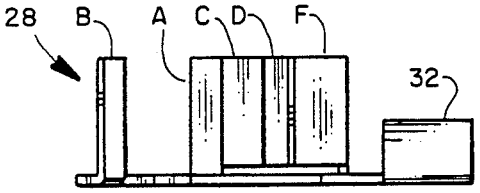

In FIGS. 7(*a*)–7(*c*) there are shown a top plan view, a side elevational view and an end view of the stationary contact members 30, 32 and 34 of the terminal contact set 28, respectively. The terminal contact set 28 is adapted to fit within the rectangularly-shaped recess 72 formed within the bottom housing portion 18 so that the three stationary contact members 30, 32 and 34 are electrically isolated from each other. The stationary contact member 30 includes a female plug receptacle 74 located at its one end for receiving the male plug connector 12 and a vertical contact engagement surface B formed upon its other end. The stationary contact member 32 includes a female plug receptacle 76 located at its one end for receiving the male plug connector 12 and a vertical contact engagement surface A formed upon its other end. The contact surface A lies in a vertical plane which intersects the vertical plane of the contact surface B at approximately 135 degrees. The center stationary contact member 34 includes a female plug receptacle 78 located at its one end for receiving the male plug connector 12 and four additional vertical electrically-connected contact engagement surfaces C, D, E and F which are located between the surfaces B and A. Each of the adjacent serially-connected contact surfaces C, D, E and F are disposed in respective vertical planes which are approximately 45 degrees apart from each other.

Figure 8:
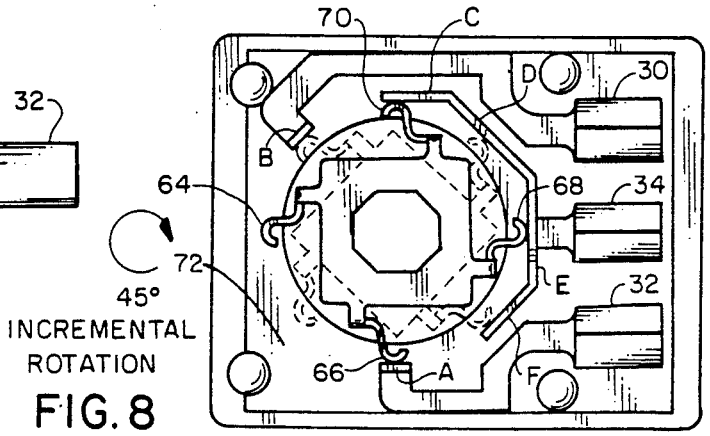
FIG. 8 is a top plan view of the rotor contact member and the terminal contact set arranged within the back cover portion of the rotary switch.

In order to provide an understanding of the operation of the index rotary switch 10 and electrical connections effected between the various rotor contacts and the stationary contact surfaces, reference is now made to FIG. 8 of the drawings. Initially, it will be assumed that the center stationary contact member 34 is operatively connected to an external power source and that each of the other stationary contact members 30 and 32 is connected to a utilization device or equipment which is to be connected means of the rotary switch. With each successive actuation of the plunger of the switch, there will alternately be provided a connection and disconnection between the stationary contact members 30, 32 and the center stationary contact member 34.

With the four arcuate-shaped rotor contacts 64–70 of FIG. 8 as shown in the solid lines, it can be seen that the rotor contact 66 engages the vertical surface A of contact 32 and that the rotor contacts 68, 70 engage the respective vertical surfaces E, C of contact 34. As a result, the center contact member 34 will be electrically connected to the contact member 32. However, there will be no connection between the center contact member 34 and the other contact member 30. When the rotary switch is actuated by pushing the same downwardly and releasing the plunger 20, the rotary index actuator mechanism will cause the rotor contact member 26 to rotate such that the four rotor contacts 64–70 (shown in the dotted lines) index with respect to the contact surfaces of the stationary contact members.

In this position, the rotor contact 64 engages the vertical surface B of contact 30 and the rotor contacts 70, 68 engage the respective vertical surfaces D, F of contact 34. Consequently, the center contact member 34 will be electrically connected to the contact member 30. Simultaneously, the center contact member 34 will be electrically isolated from the contact member 32. It can thus be seen that with each successive actuation the rotor contacts of the rotor contact member rotate incrementally 45 degrees in a clockwise fashion and alternately index with respect to the corresponding vertical surfaces A and B of the respective stationary contact members 32, 30 so as to alternately switch the contact members 32 and 30 and their associated circuits in ON and OFF modes.

It should be apparent that in the instant rotary switch there are always two of the four rotary contacts 64–70 which wipingly engage two of the four vertical contact surfaces C, D, E and F of the center contact member 34 during each on-position or state. In this manner, there is provided an increased contact area which therefore allows for a higher current carrying capability than the prior art switches having a single contact connection. As can thus be seen from FIG. 5, there is shown, for example, the arcuate-shaped rotor contact 66 that wipingly engages the vertical contact surface A of the stationary contact member 32, thereby substantially eliminating any flickering due to vibrations.

As the pushbutton or plunger 20 is depressed in the direction of the arrow shown in FIG. 5, the cam follower 22 and the rotor contact member 26 are forced to move downwardly against the opposing or biasing force of the return coil spring 24. This movement continues until the cam surface 40 of follower 22 reaches the upper surface of the post 44 at the fully depressed position of the plunger 20. When the plunger 20 is released, the return spring 24 will force the cam follower 22 to move in the direction opposite to the arrow whereupon the rotor contact member 26 is rotated 45 degrees. Thus, each successive depression and release of the plunger will rotate the cam follower and the rotor contact member 45 degrees so as to index the arcuate-shaped rotor contacts 64–70 with respect to the corresponding vertical contact surfaces of the stationary contact members of the terminal contact set so as to effect the on-off switching action.

From the foregoing detailed description, it can thus be seen that the present invention provides an improved index rotary switch which includes a rotor contact member which is formed with a rectangularly-shaped flat portion and a plurality of resilient L-shaped arms extending downwardly from respective edges thereof. The L-shaped arms are provided with arcuate-shaped rotor contacts formed upon their free ends so as to wipingly engage the stationary contact members.

While there has been illustrated and described what is at present considered to be a preferred embodiment of the present invention, it will be understood by those skilled in the art that various changes and modifications may be made thereto, and equivalents may be substituted for elements thereof without departing from the true scope of the invention. In addition, many modifications may be made so as to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. An index rotary switch, comprising:

a housing;

stationary contact means disposed within said housing for defining a predetermined number of alternately on-and-off positions;

rotor contact means disposed for rotation within said housing for wipingly engaging said stationary contact means;

said rotor contact means being formed of a rectangularly-shaped flat portion having edges and a plurality of resilient arms extending normally from said edges of said rectangularly-shaped flat portion, said arms having arcuate-shaped contacts formed at free end portions thereof so as to wipingly engage said stationary contact means; and pushbutton-operated actuator means disposed within said housing and operatively connected to said rotor contact means for sequentially rotating said rotor contact means so that said arcuate-shaped contacts alternately index with said on-and-off positions upon successive actuations of said actuator means.

2. An index rotary switch as claimed in claim 1, further comprising terminal means electrically connected to said stationary contact means adapted for electrical interconnection with an external circuit.

3. An index rotary switch as claimed in claim 2, wherein said terminal means includes spade connectors for mounting directly to a printed circuit board.

4. An index rotary switch as claimed in claim 2, wherein said terminal means includes female receptacle means adapted for receiving a male plug.

5. An index rotary switch as claimed in claim 1, wherein said flat portion of said rotary contact means has a cavity formed in its central area for engagement with said actuator means.

6. An index rotary switch as claimed in claim 5, wherein said actuator means includes a downwardly extending projection which engages with said cavity.

7. An index rotary switch as claimed in claim 6, wherein said cavity and said projection have an octagonally-shaped configuration.

8. An index rotary switch, comprising:

housing means formed of an upper housing portion and a lower housing portion which mates with said upper housing portion;

stationary contact means disposed within said housing for defining a predetermined number of alternately on-and-off positions;

rotor contact means disposed for rotation within said housing for wipingly engaging said stationary contact means;

said rotor contact means being formed of a rectangularly-shaped flat portion having edges and a plurality of resilient arms extending normally from said edges of said rectangularly-shaped flat portion, said arms having arcuate-shaped contacts formed at free end portions thereof so as to wipingly engage said stationary contact means; and pushbutton-operated actuator means disposed within a cylindrical passage formed within said upper housing portion and operatively connected to said rotor contact means for sequentially rotating said rotor contact means so that said arcuate-shaped contacts alternately index with said on-and-off positions upon successive actuations of said actuator means.

9. An index rotary switch as claimed in claim 8, further comprising terminal means electrically connected to said stationary contact means adapted for electrical interconnection with an external circuit.

10. An index rotary switch as claimed in claim 9, wherein said terminal means includes spade connectors for mounting directly to a printed circuit board.

11. An index rotary switch as claimed in claim 9, wherein said terminal means includes female receptacle means adapted for receiving a male plug.

12. An index rotary switch as claimed in claim 8, wherein said flat portion of said rotary contact means has a cavity formed in its central area for engagement with said actuator means.

13. An index rotary switch as claimed in claim 12, wherein said actuator means includes a downwardly extending projection which engages with said cavity.

14. An index rotary switch as claimed in claim 13, wherein said cavity and said projection have an octagonally-shaped configuration.

15. An index rotary switch comprising:

an electrically insulative housing;

a first stationary contact member disposed in said housing and having a first vertical contact engagement surface lying in a first plane;

a second stationary contact member disposed in said housing and having a second vertical contact engagement surface lying in a second plane, said second stationary contact member being electrically isolated from said first stationary contact member, said second contact surface lying in the second plane intersecting said first contact surface lying in the first plane at approximately 135 degrees;

a third stationary contact member disposed in said housing and having third, fourth, fifth and sixth adjacent vertical contact engagement surfaces which are serially-connected together and are located between said first and second contact surfaces, each of said third, fourth, fifth and sixth contact surfaces being disposed in respective planes which are approximately 45 degrees apart from each other;

rotor contact means including four rotor contacts disposed for rotational movement in said housing, two of said four rotor contacts simultaneously engaging two of the third, fourth, fifth and sixth contact surfaces of said third stationary contact member, one of said two remaining rotor contacts engaging one of the first and second contact surfaces on said respective first and second stationary members in each of a predetermined number of alternately on-and-off positions of said rotary contact means; and pushbutton-operated actuator means disposed in said housing and operatively connected to said rotor contact means for sequentially rotating said rotor contact means so that said four rotor contacts alternately index with said on-and-off positions upon successive actuations of said actuator means.

16. An index rotary switch as claimed in claim 15, further comprising terminal means electrically connected to said stationary contact means adapted for electrical interconnection with an external circuit.

17. An index rotary switch as claimed in claim 16, wherein said terminal means includes spade connectors for mounting directly to a printed circuit board.

18. An index rotary switch as claimed in claim 16, wherein said terminal means includes female receptacle means adapted for receiving a male plug.

19. An index rotary switch as claimed in claim 15, wherein said insulative housing is formed of an upper housing portion and a lower housing portion which mates with said upper housing portion.

20. An index rotary switch as claimed in claim 19, wherein said actuator means is disposed in a cylindrical passage formed in said upper housing portion.

21. An index rotary switch, comprising:

a housing;

stationary contact means disposed within said housing for defining a predetermined number of ON and OFF positions;

rotor contact means disposed for rotation within said housing for wipingly engaging said stationary contact means;

said rotor contact means comprising a substantially square-shaped flat portion disposed within a first horizontal plane, and a plurality of resilient arms extending downwardly from respective edge portions of said substantially square-shaped flat portion so as to be disposed within a plurality of second vertical planes, said resilient arms having arcuate-shaped contacts formed at free end portions thereof so as to tangentially wipingly engage said stationary contact means; and pushbutton-operated actuator means disposed within said housing and operatively connected to said rotor contact means for sequentially rotating said rotor contact means so that said arcuate-shaped contacts alternately index to said ON and OFF positions upon successive actuations of said actuator means.

22. A switch as set forth in claim 21, wherein:

said stationary contact means comprises three electrically isolated stationary contacts, a first one of said three stationary contacts defining a portion of a first electrical circuit, a second one of said three stationary contacts defining a portion of a second electrical circuit, and a third one of said three stationary contacts, interposed between said first and second ones of said three stationary contacts, being adapted for electrical connection to a power source such that when said rotor contact means engages said stationary contact means at said ON and OFF positions, said first and second electrical circuits are alternately connected to said power source.

* * * * *